US006866440B1

(12) United States Patent
Bart

(10) Patent No.: US 6,866,440 B1
(45) Date of Patent: Mar. 15, 2005

(54) GARBAGE DISPOSAL DRAIN STOPPER

(76) Inventor: Robert A Bart, 19413 N. 36th Pl., Phoenix, AZ (US) 85050-3901

( * ) Notice: Subject to any disclaimer, the term of this patent is extended or adjusted under 35 U.S.C. 154(b) by 7 days.

(21) Appl. No.: 10/834,718

(22) Filed: Apr. 28, 2004

(51) Int. Cl.[7] ..... A47K 1/14
(52) U.S. Cl. ..... 401/295
(58) Field of Search ..... 4/286, 293, 295

(56) References Cited

U.S. PATENT DOCUMENTS

| | | | | |
|---|---|---|---|---|
| 630,011 | A * | 8/1899 | Smith | 4/293 |
| 673,762 | A * | 5/1901 | Crabb | 4/293 |
| 1,659,839 | A | 2/1928 | Smith | |
| 1,981,358 | A | 11/1934 | Hernandez | |
| 2,611,904 | A | 9/1952 | Gros | |
| 3,995,333 | A | 12/1976 | Stephens | |
| 4,077,430 | A | 3/1978 | Brown | |
| 4,224,701 | A * | 9/1980 | Huang | 4/679 |
| 4,683,597 | A | 8/1987 | Taylor | |
| 4,926,507 | A | 5/1990 | Craig | |
| 5,226,196 | A | 7/1993 | Humlan | |
| 5,819,328 | A | 10/1998 | Lewis | |
| 5,832,545 | A | 11/1998 | Pan | |
| 5,915,847 | A | 6/1999 | Spears | |
| 6,088,844 | A | 7/2000 | Killham | |

* cited by examiner

*Primary Examiner*—Gregory L. Huson
*Assistant Examiner*—Huyen Le
(74) *Attorney, Agent, or Firm*—Donald J. Lenkszus

(57) ABSTRACT

A garbage disposal drain stopper in accordance with the invention comprises a stopper body having a top and a bottom. The garbage disposal drain stopper includes a sealing surface carried by the stopper body. The sealing surface is configured to engage a garbage disposal drain and to provide a substantially water tight seal with the garbage disposal drain. A first grip is carried on the stopper body top. A second grip is carried on the stopper body bottom. The first and second grips and the stopper body are configured to be substantially symmetrical in configuration such that the garbage disposal drain stopper is removable from a drain with substantially equal effort whether the first or the second grip is utilized. At least one of the grips includes a chamber from which a consumable may be dispensed.

8 Claims, 4 Drawing Sheets

GARBAGE DISPOSAL DRAIN STOPPER

FIELD OF THE INVENTION

This invention pertains to a drain stopper for use with a garbage disposal.

BACKGROUND OF THE INVENTION

A problem with garbage disposals of the type that are commonly utilized in home and commercial kitchens is that the drain stopper gets stuck in the sink drain opening. When existing drain stoppers are inverted as a result of inadvertence or otherwise. This problem commonly occurs when the sink is utilized to wash dishes and is filled with water. When the washing is done, the drain stopper is unplugged and may be dropped back into the sink. It seems that more often than not, the drain stopper flips upside down, plugs the drain, and traps the water in the sink. Because the drain plug is inverted, it is difficult to pull the stopper out of the drain. There is no handle or grip on the bottom of a garbage disposal drain stopper. Most of the time, the drain stopper must be pried out by inserting a kitchen knife or screwdriver or other implement along the periphery of the stopper and prying.

An additional problem with garbage disposal drains is that it is not uncommon for odors to emanate from the disposal.

SUMMARY OF THE INVENTION

In accordance with the principles of the invention, a garbage disposal drain stopper is provided in which both the top and bottom each has a handle or grip, such that in the event that the stopper becomes inverted in the garbage disposal drain, the stopper may be easily removed.

Further in accordance with the principles of the invention, a garbage disposal drain stopper includes a chamber in at least one of the handles or grips that may be utilized to hold a consumable product such as a disinfectant, soap, deodorizer or the like.

A garbage disposal drain stopper in accordance with the invention comprises a stopper body having a top and a bottom. The garbage disposal drain stopper includes a sealing surface carried by the stopper body. The sealing surface is configured to engage a garbage disposal drain and to provide a substantially water tight seal with the garbage disposal drain. A first grip is carried on the stopper body top. A second grip is carried on the stopper body bottom. The first and second grips and the stopper body are configured to be substantially symmetrical in configuration such that the garbage disposal drain stopper is removable from a drain with substantially equal effort from above whether the first or the second grip is utilized.

In accordance with one aspect of the invention the first grip is chambered and movable from and capable of being re-affixed to the garbage disposal drain stopper such that a consumable may be inserted into and contained within the first grip. The first grip is apertured for release of the consumable when the garbage disposal drain stopper is in use.

Further in accordance with the invention the garbage disposal drain stopper is chambered and movable from and capable of being re-affixed to the garbage disposal drain stopper such that a consumable may be inserted into and contained within the second grip. The second grip is apertured for release of the consumable.

In one embodiment of the invention, the first and second grips are removable from the garbage disposal drain stopper.

In accordance with one aspect of the invention the first grip is removable from the garbage disposal drain stopper.

BRIEF DESCRIPTION OF THE DRAWING

The invention will be better understood from a reading of the following detailed description in conjunction with the drawing figures, in which like designators are utilized to identify like elements, and in which the various aspects of the invention are illustrated representatively and not in exact size proportion, and in which.

DETAILED DESCRIPTION

Figure 1:
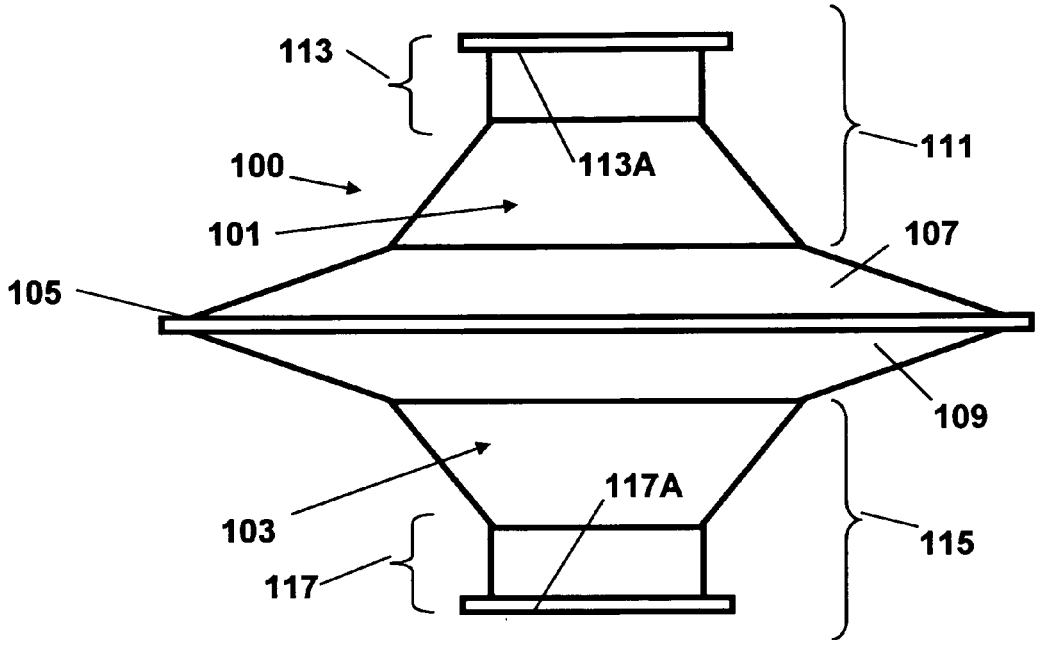
FIG. 1 is a side view of a first drain stopper in accordance with the invention.
Figure 2:
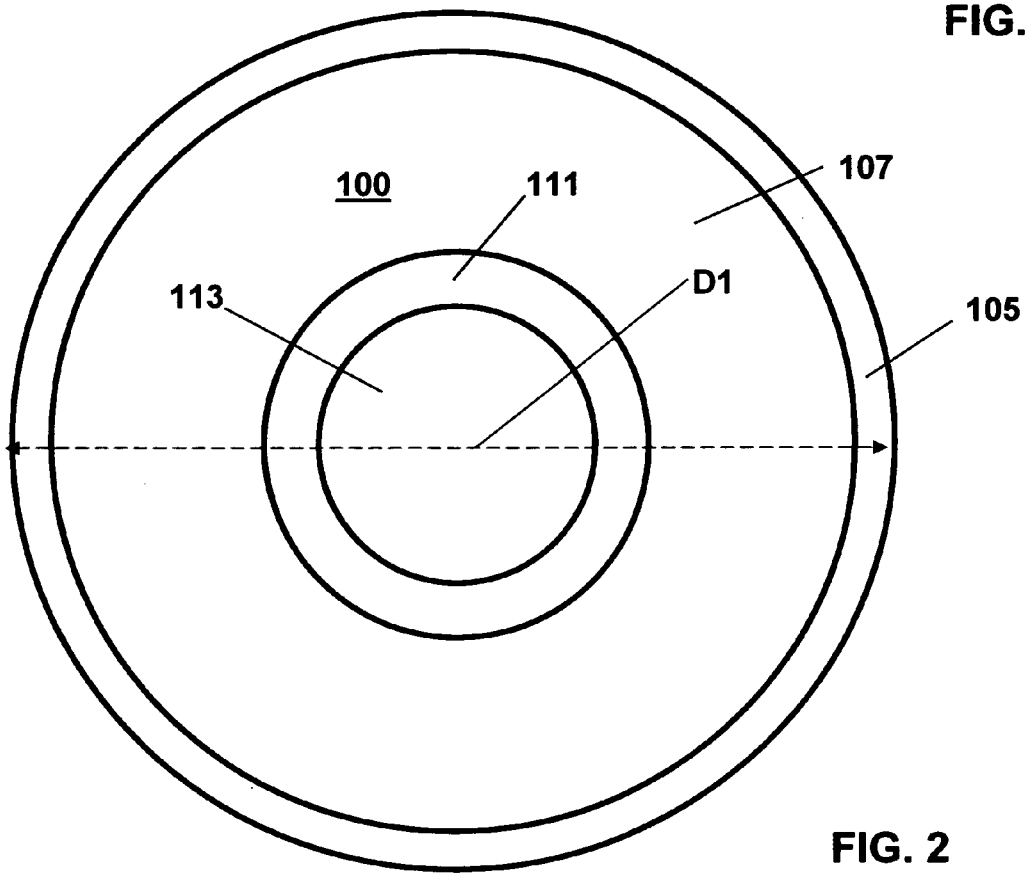
FIG. 2 is a top view of the drain stopper of FIG. 1.
Figure 3:
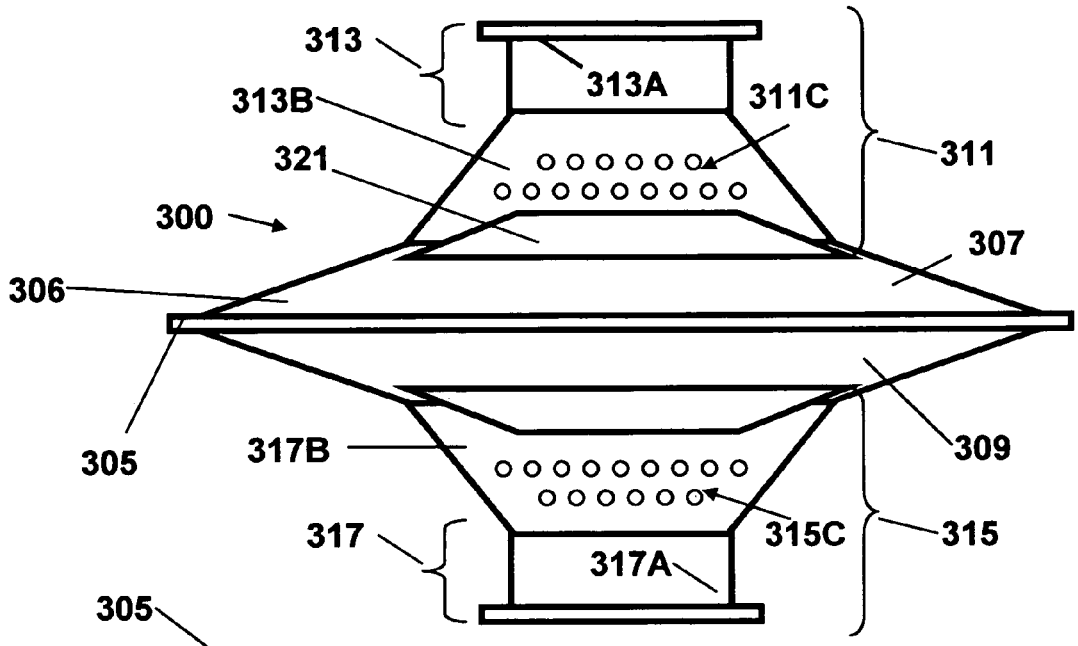
FIG. 3 is a side view of a second drain stopper in accordance with the invention.
Figure 4:
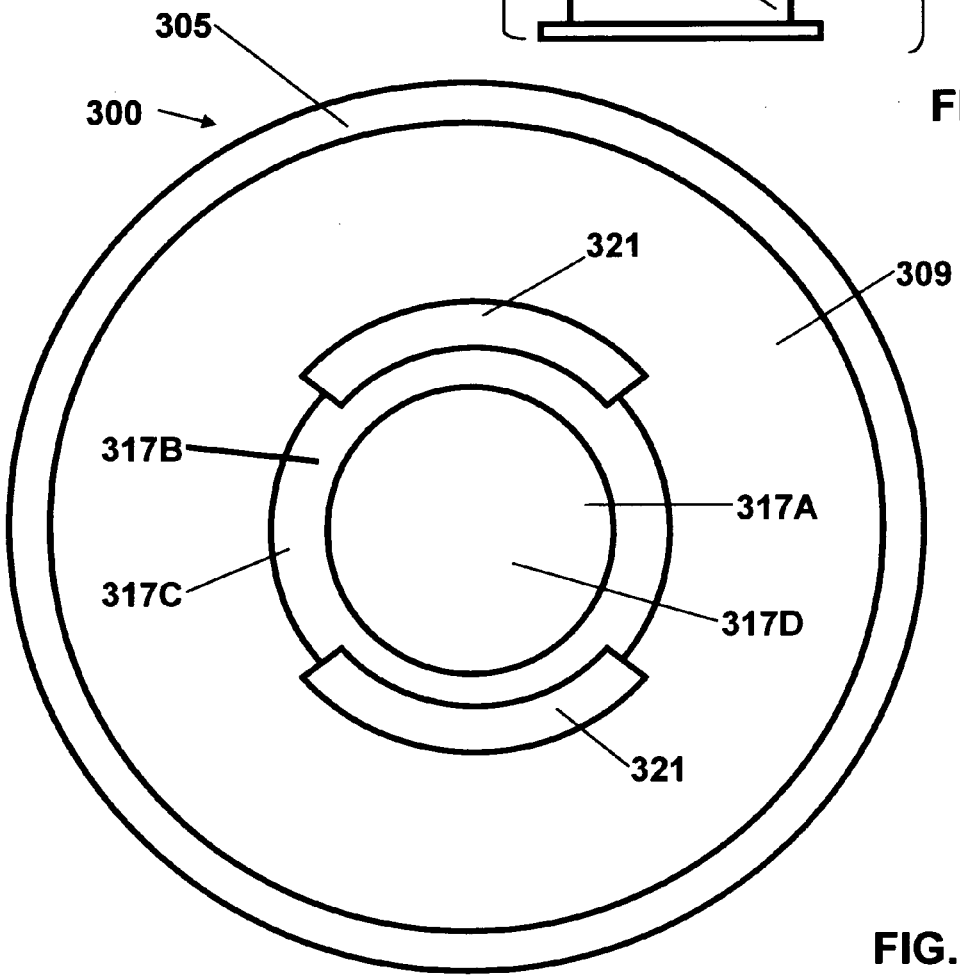
FIG. 4 is a bottom view of the drain stopper of FIG. 3.

FIGS. 1 and 2 illustrate a first drain stopper 100 in accordance with the invention. Stopper 100 has a first or top portion 101 and a second or bottom portion 103. Stopper 100 includes a peripheral seal 105 that is adapted to engage portions of a drain to which a garbage disposal is coupled. Seal 105 has a diameter D1 that corresponds to the diameter of a garbage disposal drain. Peripheral seal 105 is carried by a first or top body portion 107 and a second or bottom body portion 109. As will be appreciated by those skilled in the art, the top portion 107, bottom body portion 109 and peripheral seal 105 may be integrally formed or may be formed of two or three components fastened together.

A handle or grip portion 111 is carried on top body portion 107. A second handle or grip portion 115 is carried on bottom portion 109. Grip 111 includes a portion 113 that is easily grasped and includes a rim portion 113A that makes gripping easier. Similarly, Grip 115 includes a portion 117 that is easily grasped and includes a rim portion 117A that makes gripping easier.

As is readily apparent from the drawing, garbage disposal drain stopper 100 is substantially symmetrical such that the characterizations of top and bottom are for reference purposes only. The symmetry of stopper 100 is such that the top and bottom are substantially identical. The configuration of stopper 100 is such that grips 111, 115 apply uniform sealing pressure when stopper 100 is inserted into position in a garbage disposal drain, and have an easily graspable grip for removal of the stopper 100 from the garbage disposal drain.

Turning now to FIGS. 3, 4, 5 and 6, a second embodiment of the invention is shown. Garbage disposal drain stopper 300 has a central first or top portion 307 and a second or bottom portion 309. Stopper 300 includes a peripheral seal 305 that is adapted to engage portions of a drain to which a garbage disposal is coupled. Peripheral seal 305 is carried by a body 306 that includes first or top body portion 307 and a second or bottom body portion 309. As will be appreciated by those skilled in the art, the top portion 307, bottom body portion 309 and peripheral seal 305 may be integrally formed or may be formed of two or three components that are fastened together to form body 306.

A handle or grip portion 311 is carried on top body portion 307. A second handle or grip portion 315 is carried on bottom portion 309. Grip 311 includes a portion 313 that is easily grasped and includes a rim portion 313A that makes gripping easier. Similarly, Grip 315 includes a portion 317 that is easily grasped and includes a rim portion 317A that makes gripping easier.

As is readily apparent from the drawing, garbage disposal drain stopper 300 is substantially symmetrical such that the characterizations of top and bottom are for reference purposes only. The symmetry of stopper 300 is such that the top and bottom are substantially identical.

Figure 5:
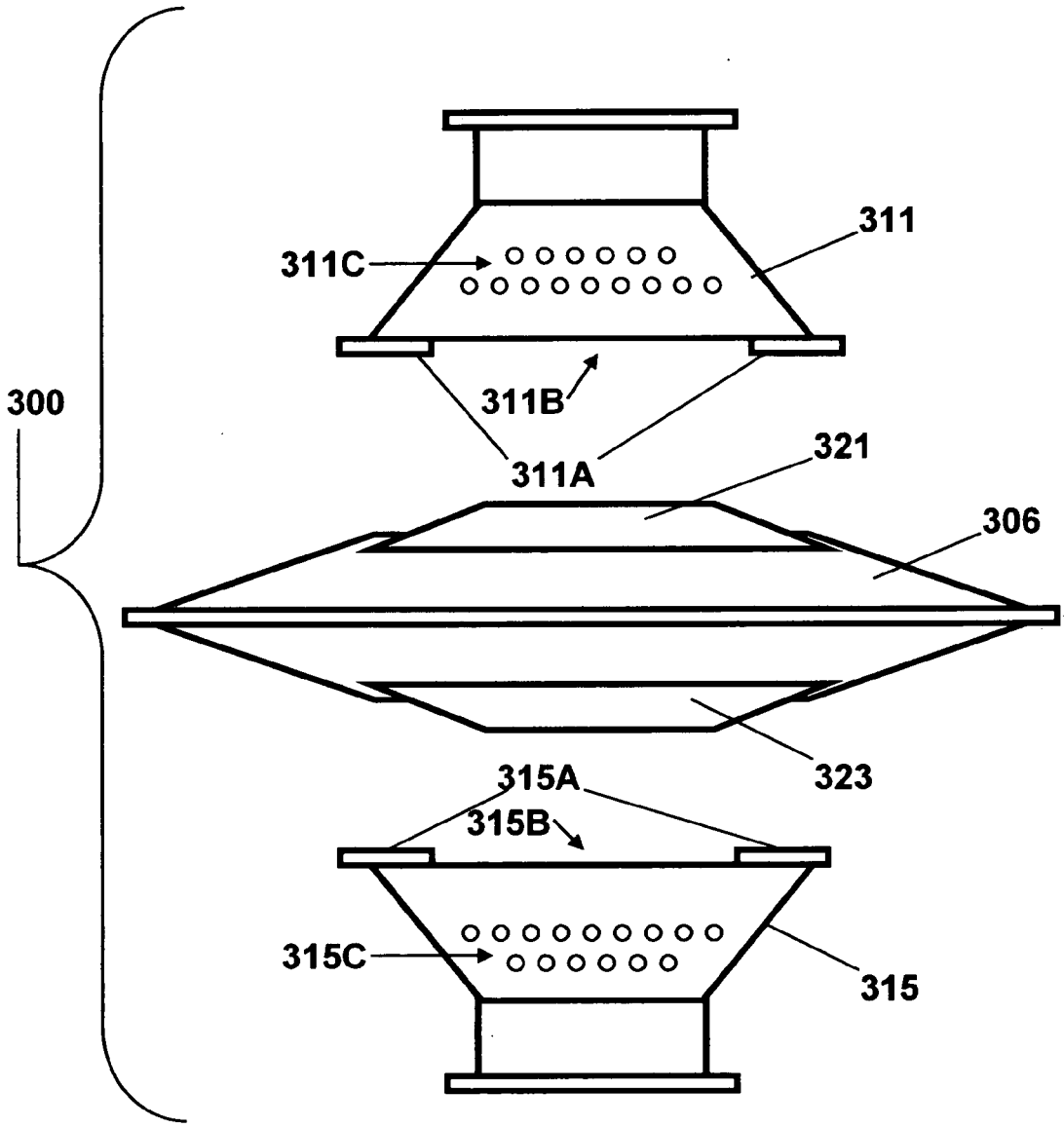
FIG. 5 is an exploded view of the drain stopper of FIG. 3.

As most clearly seen in the exploded view of FIG. 5, grips 311 and 315 are each movable from body portion 306. Grip 311 includes flanges or ears 311A that are adapted to lockingly engage corresponding flanges or ears 321 that are carried on body portion 306. To assemble grip 311 to body portion 306, grip 311 is placed into contact with body portion 306 and rotated such that flanges 311A engage flanges 321 and lock grip 311 into engagement with body portion 306.

Similarly, grip 315 includes flanges or ears 315A that are adapted to lockingly engage corresponding flanges or ears 323 that are carried on body portion 306. To assemble grip 315 to body portion 306, grip 315 is placed into contact with body portion 306 and rotated such that flanges 315A engage flanges or ears 323 and lock grip 315 into engagement with body portion 306.

In the illustrative embodiment shown, grips 311 and 315 are identical and interchangeable. However, it will be appreciated by those skilled in the art, that in other configurations of the invention, only one of the grips may be removable.

Grip 311 includes an interior chamber 311B that may be used to hold and dispense a consumable such as a deodorizer or disinfectant or the like. Grip 311 includes a surface portion including apertures 311C which permits the dispensation of the consumable. The number, type and placement of apertures 311C may be varied. Similarly, Grip 315 includes and interior chamber 315B that that may be used to hold and dispense a consumable such as a deodorizer or disinfectant or the like. Grip 315 includes a surface portion including apertures 315C which permits the dispensation of the consumable. The number, type and placement of apertures 315C may likewise be varied.

Figure 6:
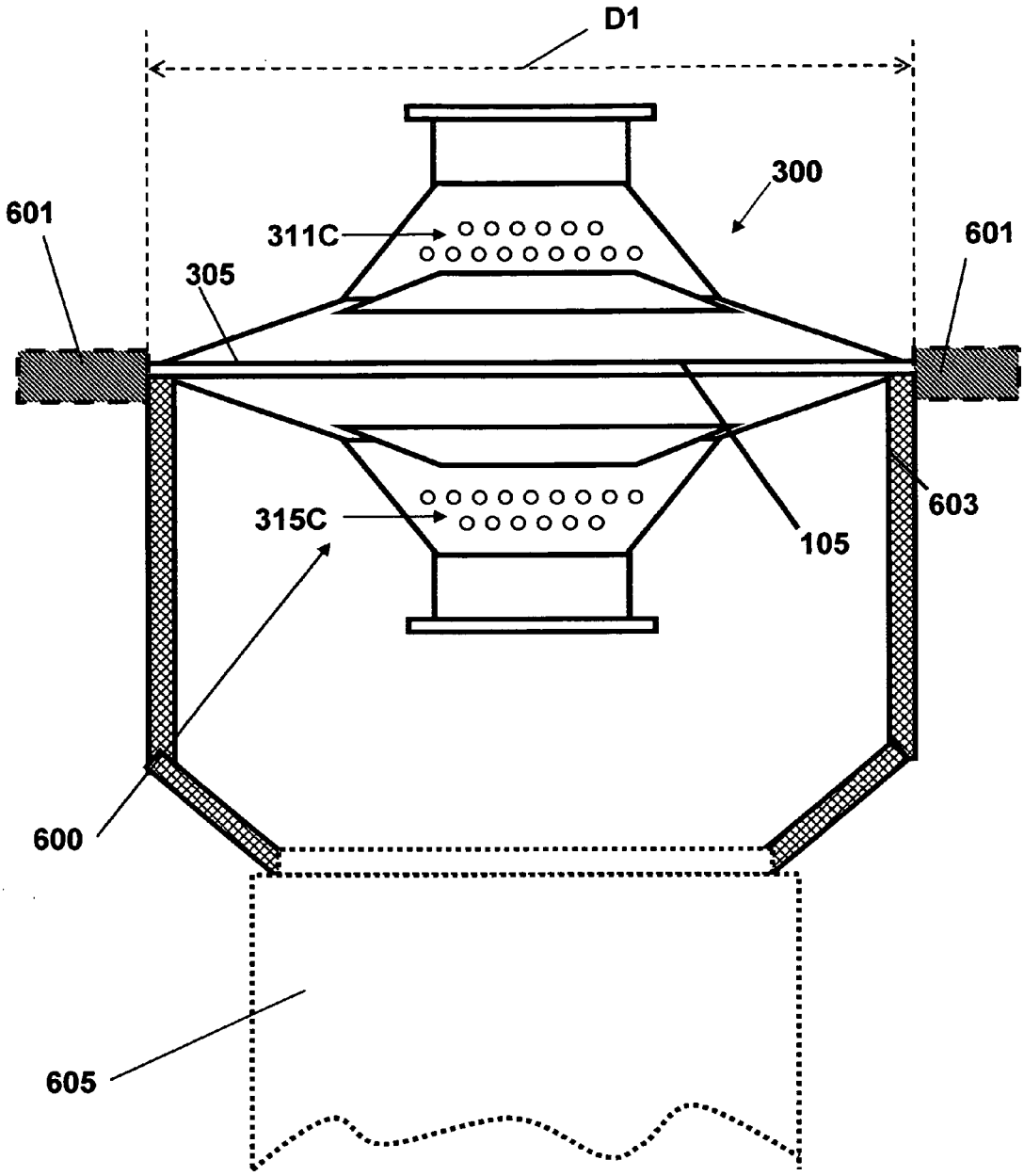
FIG. 6 illustrates the device of FIG. 3 installed in a garbage disposal drain.

Turning now to FIG. 6, a garbage disposal drain stopper 300 is shown installed in use. Stopper 300 is inserted into drain 600 of sink 601. Drain 600 includes a drain pipe 603 that leads into a garbage disposal 605. Stopper 300 has a diameter D1 that is selected so as to engage the garbage disposal drain and provide a substantially watertight seal. As can be seen, the symmetry of stopper 300 permits stopper 300 to be utilized without concern as to whether the stopper is being inserted into the drain upside down or not, since both top and bottom of the device are identical.

Although grips 311 and 315 are shown as being fully removable from body 306, and lockingly engagable with body 306, other ways of permitting one or both of grips 311, 315 to be movable with respect to body 306 may be utilized, including hinge type and swivel type connections. By way of example, each grip 311, 315 may be attached to body 306 with a living hinge such that each grip 311, 315 is movable away from body 306, and body 306 may include integral latches to engage corresponding portions of grips 311, 315.

It will be appreciated by those skilled in the art that various modifications and changes may be made to the illustrative embodiments shown and described without departing from the spirit or scope of the invention. It is not intended that the invention be limited by the illustrative embodiments shown, but that the invention be limited only by the claims appended hereto.

What is claimed is:

1. A garbage disposal drain stopper, comprising:

a stopper body, said stopper body having a top and a bottom;

a sealing surface carried by said stopper body, said sealing surface being configured to engage a garbage disposal drain and to provide a substantially water tight seal with said garbage disposal drain;

a first grip carried on said stopper body top;

a second grip carried on said stopper body bottom, said first and said second grips and said stopper body being configured to be substantially symmetrical in configuration such that said garbage disposal drain stopper is removable from a drain with substantially equal effort whether said first or said second grip is utilized;

said first grip being chambered and movable from and capable of being re-affixed to said garbage disposal drain stopper such that a consumable may be inserted into and contained within said first grip, said first grip having a first portion allowing release of said consumable when said garbage disposal drain stopper is in use.

2. A garbage disposal drain stopper in accordance with claim 1, wherein:

said first grip first portion comprising one or more apertures.

3. A garbage disposal drain stopper in accordance with claim 1, comprising:

said second grip being chambered and movable from and capable of being re-affixed to said garbage disposal drain stopper such that a consumable may be inserted into and contained within said second grip, said second grip having a portion allowing release of said consumable.

4. A garbage disposal drain stopper in accordance with claim 3, wherein:

said second grip first portion comprising one or more apertures.

5. A garbage disposal drain stopper in accordance with claim 3, wherein:

said first and said second grips are removable from said garbage disposal drain stopper.

6. A garbage disposal drain stopper in accordance with claim 1, wherein:

said first grip is removable from said garbage disposal drain stopper.

7. A garbage disposal drain stopper, comprising:

a stopper body, said stopper body having a top and a bottom;

a sealing surface carried by said stopper body, said sealing surface being configured to engage a garbage disposal drain and to provide a substantially water tight seal with said garbage disposal drain;

a first grip carried on said stopper body top;

a second grip carried on said stopper body bottom, said first and said second grips and said stopper body being configured to be substantially symmetrical in configuration such that said garbage disposal drain stopper is removable from a drain with substantially equal effort whether said first or said second grip is utilized; and said first grip being configured to carry and release a consumable when said garbage disposal drain stopper is in use.

8. A garbage disposal drain stopper in accordance with claim 7, wherein:

said second grip is configured to carry and release a consumable when said garbage disposal drain stopper is in use.

* * * * *